US008037715B2

(12) United States Patent
Hsu

(10) Patent No.: US 8,037,715 B2
(45) Date of Patent: Oct. 18, 2011

(54) RING BASE WITH RELEASABLE HOOKS

(75) Inventor: Wei Hsu, Chung Ho (TW)

(73) Assignee: Weistech Technology Co., Ltd., Chung Ho (TW)

( * ) Notice: Subject to any disclaimer, the term of this patent is extended or adjusted under 35 U.S.C. 154(b) by 925 days.

(21) Appl. No.: 12/068,382

(22) Filed: Feb. 6, 2008

(65) Prior Publication Data

US 2009/0193848 A1 Aug. 6, 2009

(51) Int. Cl.
*A44C 17/02* (2006.01)

(52) U.S. Cl. ..... 63/26; 63/33; 63/29.1

(58) Field of Classification Search ..... None
See application file for complete search history.

(56) References Cited

U.S. PATENT DOCUMENTS

| | | | | | |
|---|---|---|---|---|---|
| 635,826 | A * | 10/1899 | Wandry | 63/31 |
| 1,230,726 | A * | 6/1917 | Krause | 81/3.41 |
| 1,375,580 | A * | 4/1921 | Fisher | 294/33 |
| 1,434,886 | A * | 11/1922 | Greenfield | 63/29.1 |
| 7,055,681 | B2 * | 6/2006 | Herzog | 206/6.1 |

* cited by examiner

*Primary Examiner* — Jack W. Lavinder

(57) ABSTRACT

The present invention discloses a ring base with releasable hooks. The ring base comprises a concave part; a spring placed on the concave part; a plate including holes formed therein and attached on the spring; and hooks passing through the holes in the plate to be rotatably fixed on the concave part.

15 Claims, 4 Drawing Sheets

RING BASE WITH RELEASABLE HOOKS

FIELD OF THE INVENTION

The present invention relates to a ring base, and more particularly to a ring base with releasable hooks.

BACKGROUND OF THE INVENTION

A conventional ring base includes a ring band and a jewelry stone display. Display includes a multi-prong setting for retaining a stone. The multi-prong setting usually injures the outer surface of the stone retained therein because of the sharpness and the hardness of the prongs, thereby causing the decrease in the quality of the stone.

Furthermore, a conventional ring setting with replaceable stones includes an inclined cylindrical shoulder that defines the seat for the jewelry stone. Mounted on one of the external side of the setting is an upstanding finger with a rounded top end. Through the top of the rounded end of the finger is a through opening. Near the bottom of the finger, on the outer surface, there is an indentation. The finger is generally made integral with the setting, but could be affixed to the setting by adhesives or welding or any suitable means.

The undersurface of the cover has a cylindrical (or oval) inclined wall that defines a seat. It is intended to sit over the top portion (or crown) of the stone and to hold it in place against the setting. On each end of the cover there are parallel opposed eyes with through holes or openings. The eyes fit around the rounded end on the top of the finger and the openings are in alignment with the through opening. A pivot pin is then passed through the openings and it secures the cover to the finger. In this way, the cover can be pivoted about the finger to permit its opening and closing.

The link includes through openings at its top and bottom. The top of the link is placed between the eyes on the end of the cover and the openings are in alignment with the openings in the top of the link. A pivot pin is then passed through the openings to secure the link and cover together. This will also permit the pivotal movement of the cover and link with respect to each other.

The locking means has a central circular (or oval) section. On one end are opposed parallel eyes with through openings. The lower end of the link is placed between the eyes of the lock and the openings at the lower end of the link are in alignment with the openings of the eyes of the lock. A pivot pin is used to hold the link and the lock together. Extending upward from the planar surface of the lock is an upstanding tab. This is meant for engagement with the indentation on the lower end of the finger.

With the cover in a raised position, a stone is placed in the setting. Then, the cover pivots about the finger and closes over the stone to hold it in place. The link is then pivoted along the side of the setting and the lock is then pivoted along the undersurface of the setting and the tab at the end of the lock engages the indentation on the finger to frictionally hold the entire mechanism in place. In this manner, the stone is held securely in place.

To remove the stone, the tab on the lock is pushed downward to release it from the indentation on the finger. This permits the free movement of the lock and the link and permits the cover to be raised, to permit the removal of the stone and the replacement with another stone.

The conventional ring setting with replaceable stones as mentioned above still suffers some problem. For example, the stones to be retained therein have to be identically dimensioned, which limits the user to put stones with an identical size into the conventional ring setting. Therefore, there is still a demand for providing a ring base which can protect the stone from any injury and can retain stones with different sizes.

SUMMARY OF THE INVENTION

In view of the aforementioned defects of the conventional ring such as the injury to the stone retained therein and the limit of the size of the stone, the present invention discloses a ring base with releasable hooks.

The present invention discloses a ring base with releasable hooks. In one aspect of the present invention, the ring base comprises a concave part; a spring placed on the concave part; a plate including holes formed therein and attached on the spring; and hooks passing through the holes in the plate to be rotatably fixed on the concave part. The ring base further comprises a ring band formed below the concave part. Moreover, the concave part comprises an annular bump formed thereon to be received by the spring, and fasteners formed thereon to rotatably fix the hooks. The fasteners comprise holes formed in the upper portion thereof. The plate further comprises an opening formed in the center thereof to receive a gem. The hooks comprise holes formed in the lower portion thereof. The materials of the hooks comprise soft materials. Furthermore, the soft materials comprise silicone.

In another aspect of the present invention, the ring base comprises a concave part; a spring placed on the concave part; a plate including holes formed therein and attached on the spring; hooks passing through the holes in the plate to be rotatably fixed on the concave part; and a ring band formed below the concave part. Moreover, the concave part comprises an annular bump formed thereon to be received by the spring, and fasteners formed thereon to rotatably fix the hooks. The fasteners comprise holes formed in the upper portion thereof. The plate further comprises an opening formed in the center thereof to receive a gem. The hooks comprise holes formed in the lower portion thereof. The materials of the hooks comprise soft materials. Furthermore, the soft materials comprise silicone.

One advantage of the present invention is that the soft materials of the hooks of the ring base can protect the gem attached thereon from any injury.

Another advantage of the present invention is that the gem attached on the ring base can be replaced with other jewelry at user's pleasure.

Still another advantage of the present invention is that the ring base can retain gems with different sizes.

Still another advantage of the present invention is that the ring base can be applied to any kinds of necklaces or accessories.

These and other advantages will become apparent from the following description of preferred embodiments taken together with the accompanying drawings and the appended claims.

BRIEF DESCRIPTION OF THE DRAWINGS

The present invention may be understood by some preferred embodiments and detailed descriptions in the specification and the attached drawings below. The identical reference numbers in the drawings refer to the same components in the present invention. However, it should be appreciated that all the preferred embodiments of the invention are only for illustrating but not for limiting the scope of the Claims and wherein:

DETAILED DESCRIPTION OF THE PREFERRED EMBODIMENT

The invention will now be described with the preferred embodiments and aspects and these descriptions interpret structure and procedures of the invention only for illustrating but not for limiting the Claims of the invention. Therefore, except the preferred embodiments in the specification, the present invention may also be widely used in other embodiments.

Figure 1:
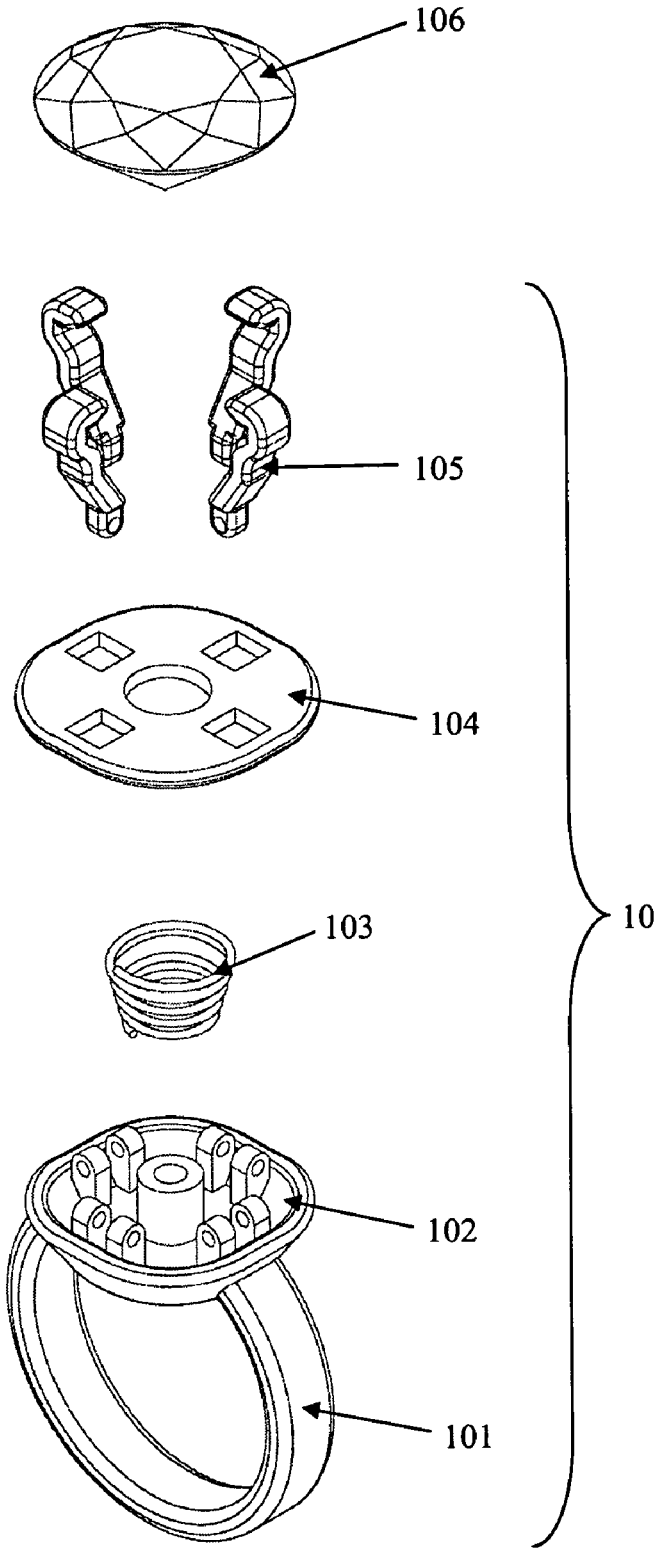
FIG. 1 is an exploded diagram of a ring base according to the present invention.
Figure 2:
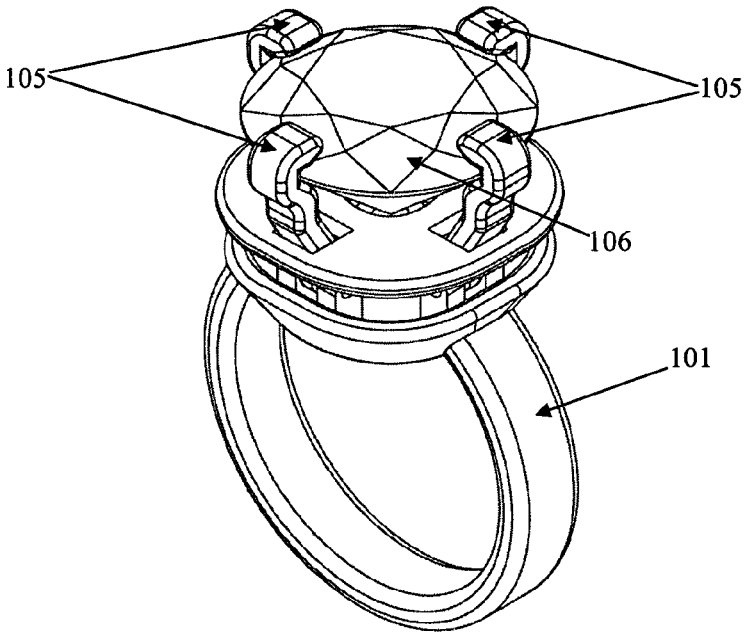
FIG. 2 is a diagram of the ring base according to the present invention.

The present invention provides a ring base with releasable hooks to replace the gem attached thereon with other jewelry. With reference to FIG. 1 and FIG. 2, the ring base 10 includes a ring band 101, a concave part 102 formed on the top of the ring band 101, a spring 103 placed on the concave part 102, a plate 104 attached on the spring 103, and four hooks 105 passing through the plate 104 to be rotatably fixed on the concave part 102. The hooks 105 retain a gem 106 toward the center of the plate 104 as shown in FIG. 2. As known in the art, the gem 106 includes stones, such as a solitaire, other type of diamond, or any other stone, including pearls.

Figure 3:
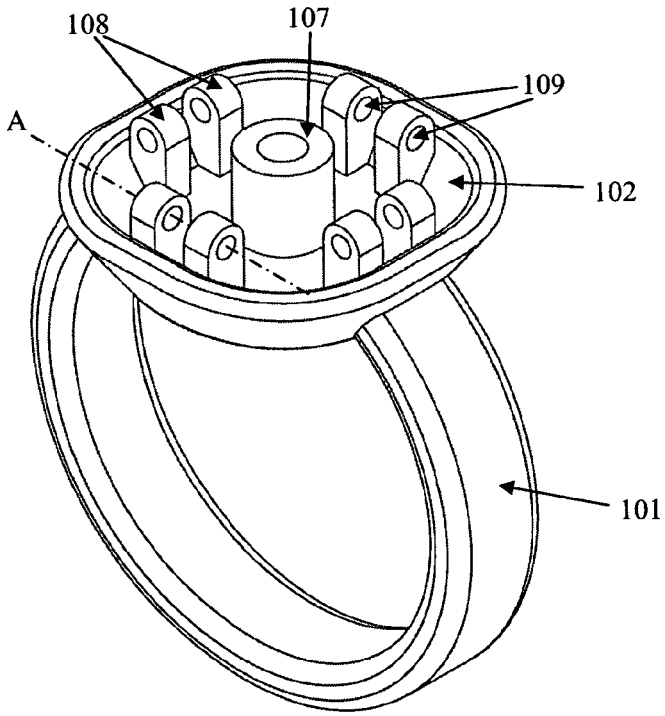
FIG. 3 is a diagram of a ring band and a concave part of the ring base according to the present invention.
Figure 4:
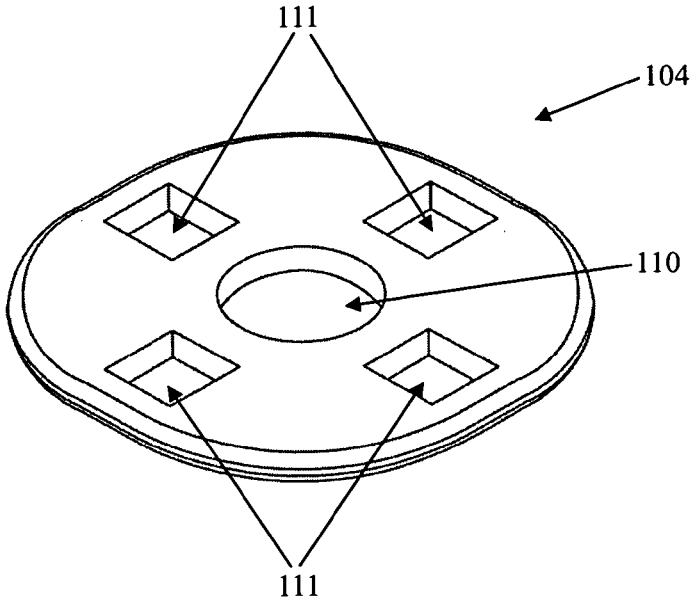
FIG. 4 is a diagram of a plate of the ring base according to the present invention.
Figure 5:
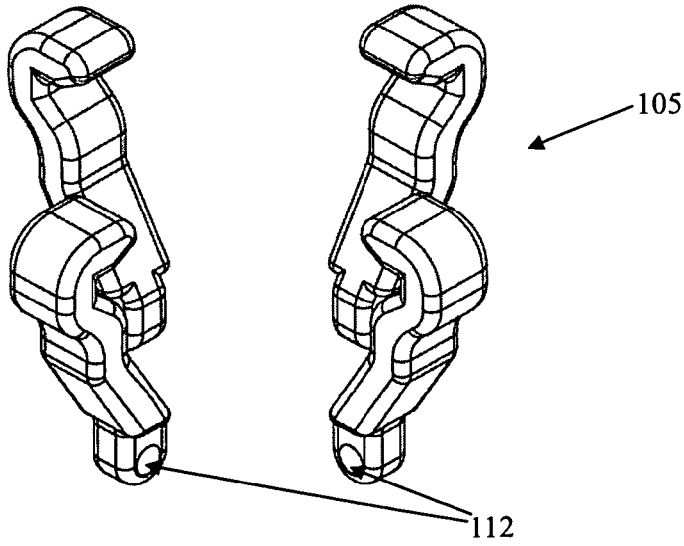
FIG. 5 is a diagram of hooks of the ring base according to the present invention.

With reference to FIG. 3, the concave part 102 is formed between two ends of the ring band 101 and includes an annular bump 107 and four pairs of fasteners 108 which are formed on the upper surface of the concave part 102. One end of the spring 103 receives the annular bump 107, and the other end of the spring 103 is disposed below the plate 104. Each pair of the fasteners 108 includes two holes 109 formed respectively in the upper portions thereof. Each of the hooks 105 includes a hole 112 formed in the lower portion thereof as shown in FIG. 5. The holes 109 and the hole 112 are identically dimensioned to couple with each other when the ring base 10 is assembled. The fasteners 108 rotatably fix the lower ends of the hooks 105 on the concave part 102, thereby causing the hooks 105 to be rotatable around the axis A between the two holes 109 in the fasteners 108 as shown in FIG. 3. With reference to FIG. 4, the plate 104 includes an opening 110 formed in the center thereof to receive the lower part of the gem 106. The plate 104 further includes four holes 111 formed around the opening 110 to be passed through by the hooks 105.

Figure 6:
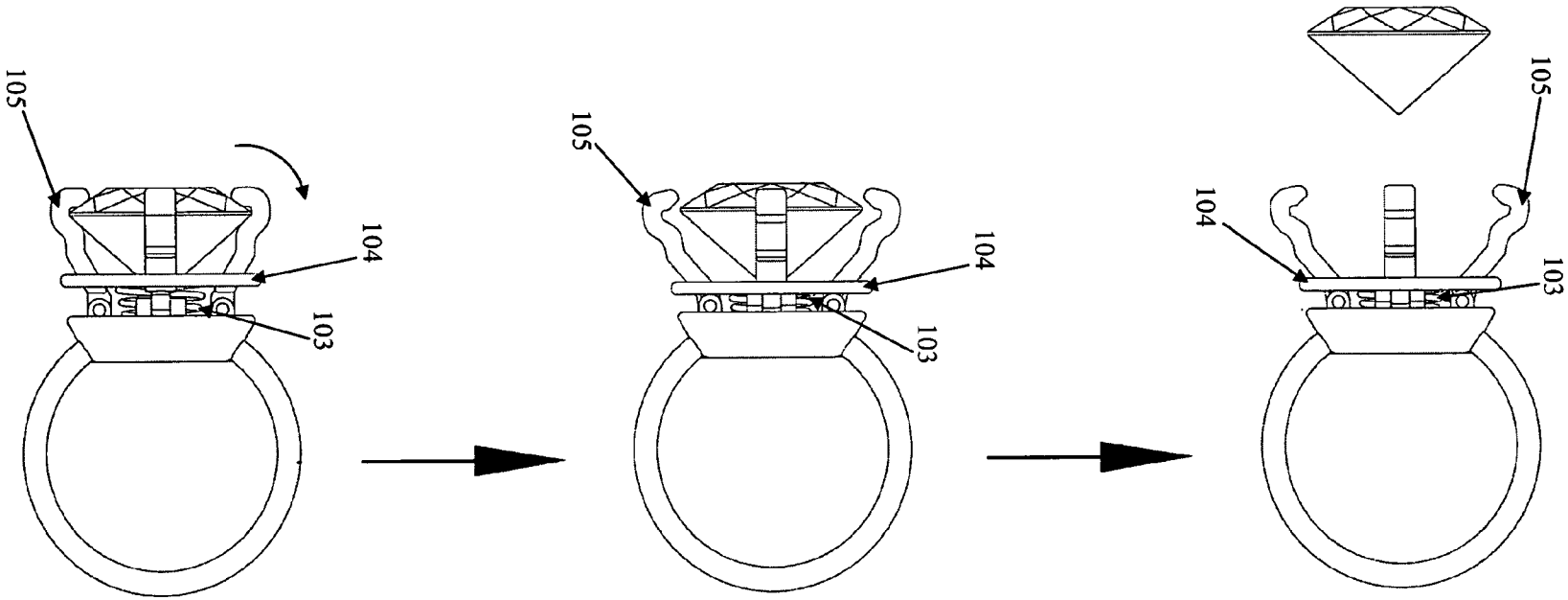
FIG. 6 shows the movement of hooks of the ring base according to the present invention.

With reference to FIG. 6, the plate 104 can be lowered down to enable the hooks 105 to rotate around the axis A between the two holes 109 in the fasteners 108 from a first position at which the gem 106 is retained among the hooks 105 and the spring 103 is expanded to a second position at which the hooks 105 loosen and leave the surface of the gem 106 and the spring 103 is compressed. Therefore, when the hooks 105 are at the second position, the gem 106 can be removed from the ring base 10 to be replaced with another gem as shown in FIG. 6. After another gem is put onto the opening 110 in the plate 104, the plate 104 can be lifted up by the spring 103 and the hooks are rotated back to the first position to retain the gem. Furthermore, the springs 103 enable the ring base 10 of the present invention to retain gems with different sizes. In one embodiment, the hooks 105 are made of soft material, for example, silicone, such that the gem 106 will not be injured by the hooks 105. It should be appreciated that the present invention can be applied to any kinds of necklaces or accessories with gems. Accordingly, the present invention provides a ring base with releasable hooks to protect the gem from any injury, replace the gem at the user's pleasure, and retain gems with different sizes.

In the assembling process of the present invention, firstly the ring band 101 is prepared and then the concave part 102 with the annular bump 107 and fasteners 108 is welded between the two ends of the ring band 101. Subsequently, the spring 103 is attached on the annular bump 107 and receives it at one end. The plate 104 is then attached on the other end of the spring 103. The hooks 105 are inserted into the holes 111 in the plate 104 and rotatably fixed onto the fastener 108 to form the ring base 10.

The foregoing description is a preferred embodiment of the present invention. It should be appreciated that this embodiment is described for purposes of illustration only, not for limiting, and that numerous alterations and modifications may be practiced by those skilled in the art without departing from the spirit and scope of the invention. It is intended that all such modifications and alterations are included insofar as they come within the scope of the invention as claimed or the equivalents thereof.

What is claimed is:

1. A ring base, comprising:
- a concave part;
- a spring placed on said concave part;
- a plate including holes formed therein and attached on said spring; and
- hooks passing through said holes in said plate to be rotatably fixed on said concave part,
- wherein said plate comprises an opening formed in a center thereof to receive a gem.

2. The ring base of claim 1, wherein said concave part is used for connecting a ring band below said concave part.

3. The ring base of claim 1, wherein said concave part comprises an annular bump formed thereon to be received by said spring.

4. The ring base of claim 1, wherein said concave part comprises fasteners formed thereon to pivotably mount said hooks to said concave part.

5. The ring base of claim 4, wherein said fasteners comprise holes formed in an upper portion thereof.

6. The ring base of claim 1, wherein said hooks comprise holes formed in an lower portion thereof.

7. The ring base of claim 1, wherein the materials of said hooks comprise soft materials.

8. The ring base of claim 7, wherein said soft materials comprise silicone.

9. A ring base, comprising:
- a concave part;
- a spring placed on said concave part;
- a plate including holes formed therein and attached on said spring;
- hooks passing through said holes in said plate to be rotatably fixed on said concave part; and
- wherein said concave part is used for connecting a ring band below said concave part, and
- wherein said plate comprises an opening formed in a center thereof to receive a gem.

10. The ring base of claim 9, wherein said concave part comprises an annular bump formed thereon to be received by said spring.

11. The ring base of claim 9, wherein said concave part comprises fasteners formed thereon to pivotably mount said hooks to said concave part.

12. The ring base of claim 11, wherein said fasteners comprise holes formed in an upper portion thereof.

13. The ring base of claim 9, wherein said hooks comprise holes formed in an lower portion thereof.

14. The ring base of claim 9, wherein the materials of said hooks comprise soft materials.

15. The ring base of claim 14, wherein said soft materials comprise silicone.

* * * * *